United States Patent [19]

Miller et al.

[11] Patent Number: 4,987,275

[45] Date of Patent: Jan. 22, 1991

[54] MULTI-POLE MOMENTARY MEMBRANE SWITCH

[75] Inventors: Meryl E. Miller, Rancho Palos Verdes; Leroy N. Nopper, Irvine; David D. Lewis, La Habra, all of Calif.

[73] Assignee: Lucas Duralith Corporation, Millville, N.J.

[21] Appl. No.: 382,747

[22] Filed: Jul. 21, 1989

[51] Int. Cl.[5] ..... H01H 1/00; H01H 13/70

[52] U.S. Cl. ..... 200/5 A; 200/513; 200/275

[58] Field of Search ..... 200/5 R, 5 A, 512–517, 200/275

[56] References Cited

U.S. PATENT DOCUMENTS

| | | | |
|---|---|---|---|
| 4,156,802 | 5/1979 | Gilano et al. | 200/517 X |
| 4,207,443 | 6/1980 | Matsuura | 200/512 X |
| 4,463,234 | 7/1984 | Bennewitz | 200/5 A X |
| 4,477,700 | 10/1984 | Balash et al. | 200/5 A |
| 4,501,938 | 2/1985 | Kawauchi | 200/5 A |
| 4,508,942 | 4/1985 | Inaba | 200/513 X |

*Primary Examiner*—J. R. Scott

*Attorney, Agent, or Firm*—Nixon & Vanderhye

[57] ABSTRACT

A membrane keyboard is comprised of a dielectric substrate and an overlying deflectable membrane layer separated by a spacer. A plurality of contact poles are located on the dielectric substrate with an electrically conductive common contact area located on the flexible membrane. A portion of the flexible membrane is locally stiffened and, in a preferred embodiment, provided with a ridge extending away from a portion of the membrane towards the contact poles. Upon actuation of the switch, the stiffened portion of the membrane ensures simultaneity of contact between the common contact area on the membrane and the contact poles on the substrate. Preferred embodiments utilize a generally circular ridge in the deflectable membrane cooperating with interdigitated contact poles.

13 Claims, 4 Drawing Sheets

MULTI-POLE MOMENTARY MEMBRANE SWITCH

BACKGROUND AND SUMMARY OF THE INVENTION

1. Field of the Invention

The present invention generally relates to membrane switches and specifically relates to multiple pole momentary contact membrane switches having improved contacts.

2. Description of Prior Art

Existing membrane switches comprise a dielectric substrate, a flexible membrane which extends parallel to the substrate and a separator which is inserted between opposed surfaces of the membrane and the substrate. Circuit conductors and switch sites are provided on the opposed surfaces and frequently either the membrane or the substrate will be provided with an integral tail onto which the circuit conductors extend. The switch can then be connected to external circuits by means of a connector coupled to the end portions of the conductors on the tail.

The substrate and indeed the membrane can comprise a sheet of insulative material, such as Mylar with circuit patterns disposed thereon. Mylar can also be used as the spacer layer, although such spacer layers may also be formed by applying a printed or silk screened aperture pattern of a dielectric material to one or both of the substrate and membrane layers. The advantage of a printed or silk screened dielectric layer is that it can generally be made thinner than conventional spacer sheets. Silk screened layers can be on the order of from 0.001 to 0.002 inches thick while conventional spacer sheets are typically 0.003 to 0.005 inches thick.

Membrane switches have achieved wide acceptance for momentary contact switch applications. When the flexible plastic membrane which carries the movable contact is deformed, it moves towards a fixed contact on the substrate and, upon physically touching the fixed contact, the electrical switch connection is made. Upon release of the tactile pressure, the circuit is broken. While the above construction works well for single pole switches, there are a number of applications which require multi-pole switch contact, i.e. actuation of the switch resulting in the contacting of several circuits simultaneously. It is this multi-pole application which has caused problems for the conventional membrane switch.

Conventional multi-pole membrane switches have a spot-contact which is inherent in the membrane switch design. The sheet plastic membrane, which carries the movable contact, is flat only when the switch is not actuated. As soon as a force deforms the membrane towards the fixed contacts (whether through a tactile dome or a digit), the surface of the movable contact becomes curved. This curved surface touches the fixed surface and its contacts at a single spot at least initially. This then causes the curved surface to become flat at that single spot and with increasing pressure, the size of the flat portion grows to encompass the multiple contacts which may be placed on the fixed substrate. Accordingly, the multiple contacts may be made at different points in time resulting in a non-simultaneous interconnection.

Telephone equipment often uses the dual tone multi-frequency (DTMF) method for generating dialing tones. This method of tone generation requires two different audible frequency tones to be combined when a number key is pressed. A dual contact (two-pole) momentary membrane switch is a direct approach since one of each of the two frequencies can be continually present at each of two-pole contacts. These are mixed when the common movable contact touches both pole contacts. The failure to provide simultaneous making and breaking of the contacts can result in erroneous tone generation and misdialing of the telephone number. Obviously, if such a system is utilized as an input pad for a computer terminal, incorrect information can be supplied.

SUMMARY OF THE INVENTION

In view of the above and other disadvantages of prior art multi-pole membrane switches, it is an object of the present invention to provide a membrane switch with provides consistent reliable operation.

It is a further object of the present invention to provide a multi-pole momentary membrane switch which ensures simultaneity of contact between the poles and the movable contact.

The above and other objects are achieved by providing a movable contact which is embossed so as to have a stiffened region displaced away from the fixed multiple contacts. In one embodiment the movable contact planar portion and the embossed or displaced portion forms a ridge which is coated with a conductive material and makes electrical contact with the fixed contacts.

In a preferred embodiment, the movable membrane has an embossed circular design shaped like a shallow flat-bottomed bowl which has conductive material on the inside portion of the bowl. This forms an open edge or rim which, when deflected downward towards the contacts, will simultaneously contact multiple fixed contacts alleviating problems with time differential contacts in prior art membrane switches.

Additional features and advantages of the invention will become obvious from the detailed description taken in conjunction with the accompanying drawings and claims.

DETAILED DESCRIPTION OF PREFERRED EMBODIMENTS

In the following discussion, similar structural elements are similarly labelled to facilitate understanding of the various views of the present invention.

Figure 1:
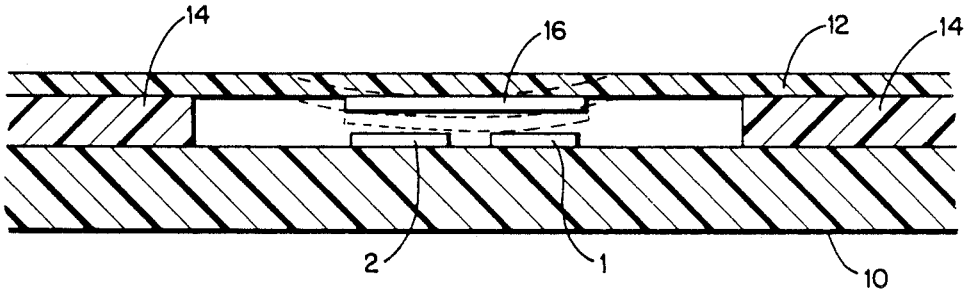
FIG. 1 (PRIOR ART)
FIG. 1 is a cross-sectional view of a typical prior art two-pole momentary membrane switch.

FIG. 1 is a side cross-sectional view of a typical two-pole membrane switch. A lower substrate 10 may be comprised of any dielectric structure, although in a preferred embodiment it is a printed circuit board includes the multiple pole membrane switch. A membrane layer 12 is deflectable in a downward direction and may be comprised of an appropriate polyester material such as Mylar. A spacer means 14 is provided to separate a membrane layer 12 from the lower substrate 10.

On the lower substrate are placed two pole contacts, 1 and 2, respectively, which are electrically connected to their respective circuit elements (not shown). Disposed above pole contacts 1 and 2 and on the underside of membrane layer 12 is a conductive common contact area 16 which is an electrical "common", such that when the membrane layer 12 is deflected downwardly, a low resistance electrical connection is formed simultaneously between the common contact area and pole contacts 1 and 2.

In a typical prior art momentary switch, the pole contacts and the common contact area may be provided by screened silver conductive ink having a thickness of from about 0.0005 to 0.0007 inches thick. The spacer means 14 can be comprised of a similar polyester film or can be a screen printable dielectric coating printed over those areas in which a spacer is to be located. If a separate film is utilized to comprise the spacer means, an adhesive or any other suitable means can be used to maintain the spacer in its appropriate position relative to the substrate. Similarly, an adhesive can be utilized to maintain the membrane layer 12 in its proper position such that common contact area 16 is located immediately over pole contacts 1 and 2. Various dimensions and materials for comprising such a membrane switch are well known to those of ordinary skill in the art.

Figure 2:
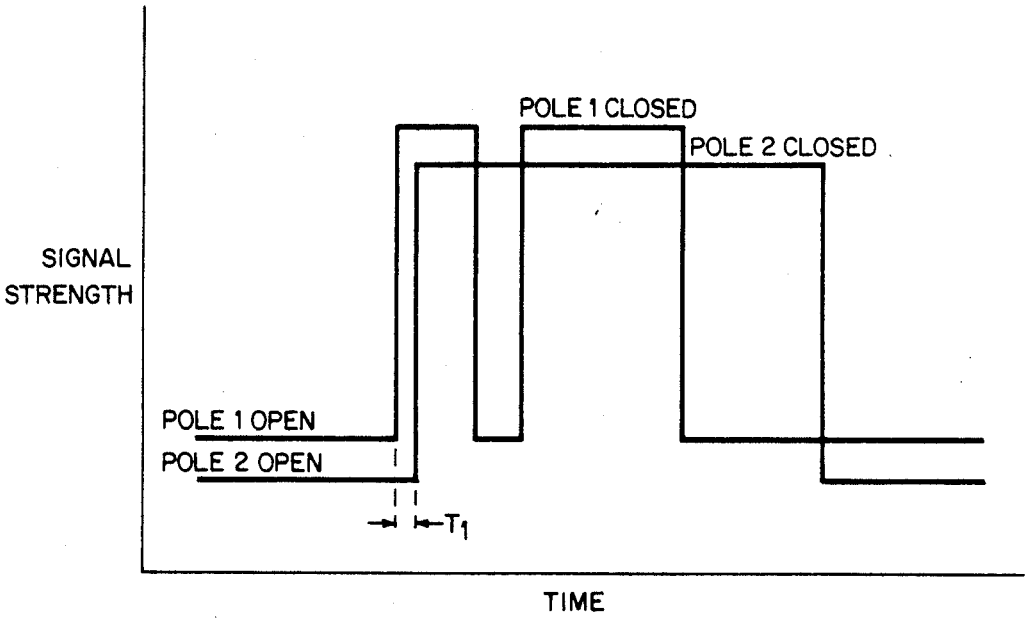
FIG. 2 (PRIOR ART)
FIG. 2 is a graph of signal strength versus time for each pole of the switch of FIG. 1.

FIG. 2 is a graph representative of an oscilloscope tracing indicating the result when a conventional two-pole momentary membrane switch is actuated by a tactile dome (not shown). It can be seen that, although the membrane layer 12 is actuated at a given time, the actual time at which pole contacts 1 and 2 close with the common contact area can differ by T1 as shown. Therefore, simultaneous signals would not be provided at the common contact area 16. Additionally, although pole 2 remains closed for the duration of actuation of the switch, pole 1 encounters a phenomenon known as "contact bounce" in which for a brief period of time the contacts are physically separated such that electrical conduction is broken and then reengaged between the common common contact area 16 and pole contact 1. It can also be seen that when the switch is released, the time at which the poles 1 and 2 terminate their conduction with common contact area 16 also varies substantially.

The above discussed problems with prior art multiple pole momentary contact switches (non-simultaneous closing of conductors, contact bounce, and non-simultaneous opening of conductors) are believed to be caused by the fact that the common contact area 16 is only planar prior to the actuation of the switch. The dotted line in FIG. 1 is intended to illustrate the deformation of membrane layer 12 and its common contact area 16 when the switch is actuated. The dotted line shows that initially pole contact 2 may make electrical contact with the deformed common contact area 16 prior to pole contact 1. Attempts by the applicants to solve this problem by means of using thicker membrane layers 12 only resulted in higher actuation forces necessary to operate the switch and did not ensure simultaneity of contact between the common contact area 16 and pole contacts 1 and 2.

Figure 3:
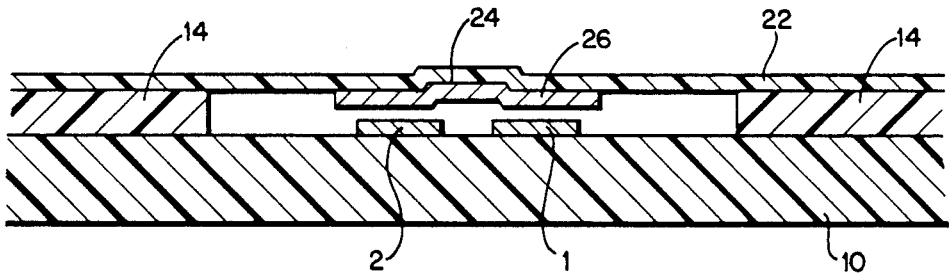
FIG. 3 is a cross-sectional view of a two-pole momentary membrane sWitch in accordance with the present invention.

FIG. 3 illustrates a construction for a two-pole momentary membrane switch in accordance with the present invention. The construction of this switch is similar to that described above with reference to FIG. 1 with the exception that the upper layer comprises an embossed membrane layer 22 with a non-planar portion of the membrane located above the pole contacts 1 and 2. The embossed membrane layer has a depression 24 which extends outwardly of the switch and in a preferred embodiment is created by embossing the membrane layer 22. However, the structure could also be created by casting, etching or any other suitable processing of the membrane layer. The conductive material is applied to the undersurface of the embossed membrane layer 22 either before or after the depression forming operation. The end result is a non-planar common contact area 26 which, in a preferred embodiment, comprises a circular ring or ridge which extends over the pole contacts 1 and 2. As discussed herein, the non-planar ridge means an edge or ridge of conductive material extending beyond a portion of the planar membrane layer which in the embodiment shown is the depressed portion of the membrane (away from the contact poles).

In a preferred embodiment, the membrane layer 22 is a polyester film 0.005 inches in thickness and the depth of the embossed depression has a diameter of from 0.1 to 0.2 inches with a depth of depression from 0.003 to 0.006 inches deep. In the preferred embodiment, the depression was hydroformed in which the membrane layer is situated on top of a planar structure having machined cavities 0.170 inches in diameter. The hydroforming mold is then closed and a hydraulic bladder inflated above the membrane layer, forcing the membrane layer to be plastically deformed into the cavity. After completion of the hydroforming step, there is a certain amount of elastic springback to the polyester material but there also remains a dimple or depression as described.

The dimple or depression serves as a local stiffening means for the membrane layer 22 and at the same time provides a line contact ridge on the common contact area which can contact the pole contacts 1 and 2. The local stiffening means providing the non-planar ridge, serves two functions which are believed important in the proper operation of this invention. First, the area of the depression and the immediate surrounding vicinity of the membrane layer is structurally stiffened so that it tends to remain in a generally planar orientation. If this structure is located within the centroid of the aperture of the spacer in which the contacts are located, when the depression is pressed (for switch actuation) equal tension on the membrane surrounding the depression will be created. This equal tension ensures that the depression and the non-planar ridge around the periphery of the depression remain parallel to the multiple pole contacts 1 and 2 located therebelow.

Secondly, even though there is now a circular non-planar ridge surrounding the depression, upon actuation the center portion of the depression will be deformed downwardly and, without the ridge present, could form an initial point contact between one or the other of the pole contacts causing a lack of simultaneity in contact between the pole contacts 1 and 2. Thus, the depression serves to ensure that the planar portion of the depression does not inadvertently cause a contact between common contact area 26 and pole contacts 1 and 2 and instead ensures that it is the non-planar ridge which causes such contact.

Figure 4:
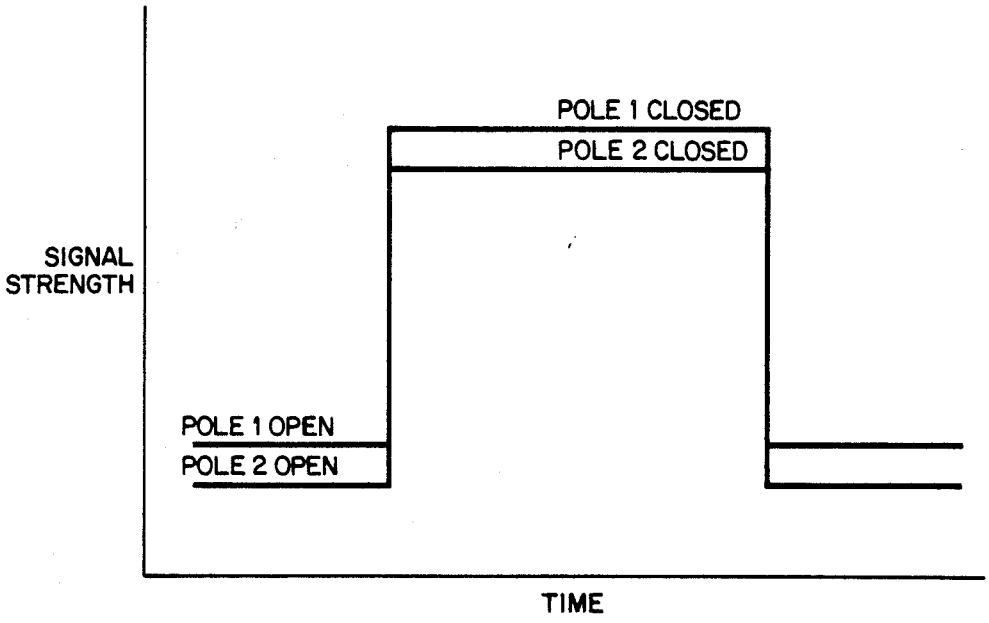
FIG. 4 is a graph of signal strength versus time for the actuation of the switch in FIG. 3.

FIG. 4 is a graph of signal strength versus time for a typical actuation of the two-pole membrane momentary membrane switch of FIG. 3. It can be seen that the prior art problems have been solved in that there is simultaneity closing of electrical contact between poles 1 and 2 and common contact area 26, there is no evidence of contact bounce and there is simultaneity of breaking of the contact between poles 1 and 2 and common contact area 26. The abovementioned problems existent in prior art multi-pole momentary contact membrane switches have been completely solved.

Figure 6:
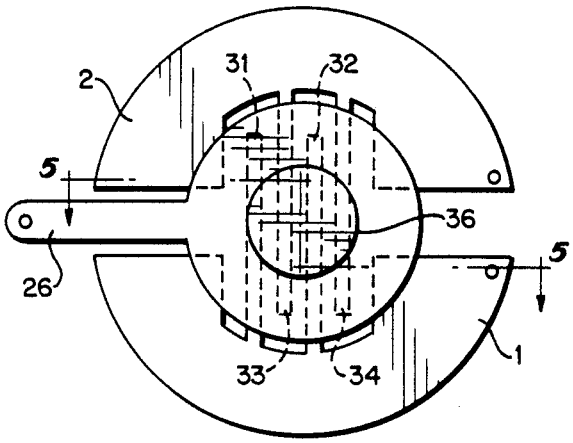
FIG. 6 is a plan view showing the arrangement of the electrical contacts in the switch of FIG. 5; and FIGS. *7a* through *7c* illustrate various contact arrangements for multiple pole momentary contact membrane switches.
Figure 5:
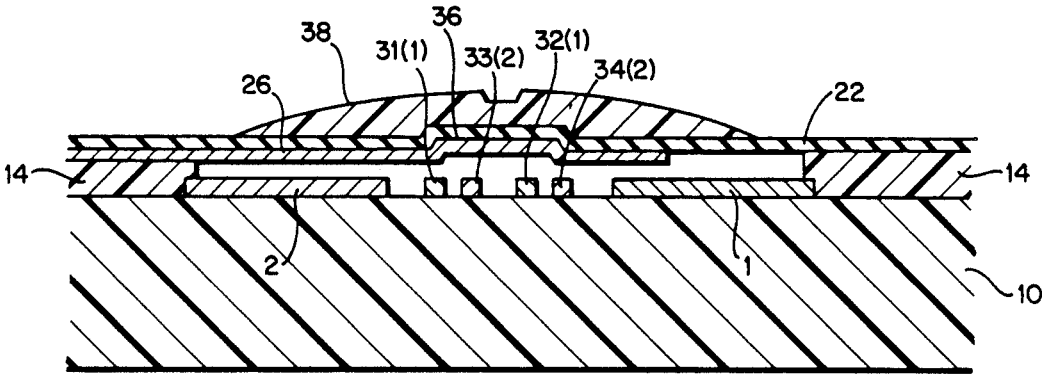
FIG. 5 is a cross-sectional view along section lines 5—5 of FIG. 6, showing a two-pole momentary membrane switch in accordance with the present invention including a tactile dome.
Figure 7A:
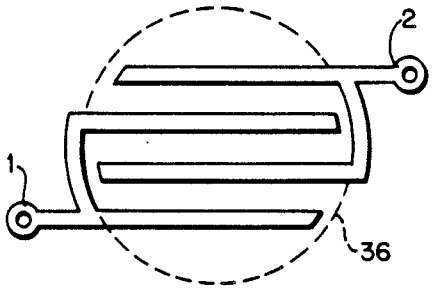
Figure 7B:
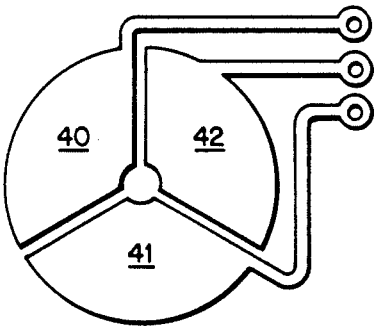
Figure 7C:
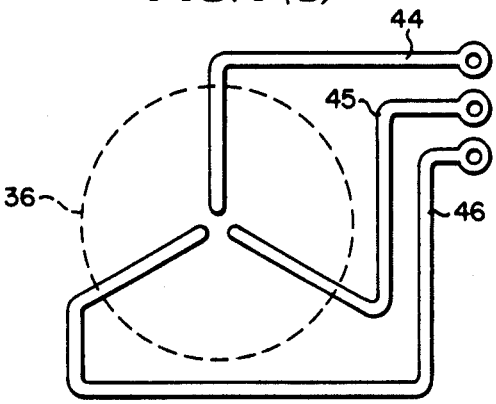

FIG. 5 illustrates a further preferred embodiment of a two-pole momentary membrane switch in which the two pole contacts have interdigitated fingers. FIG. 6 is a top view of only the non-planar common contact area 26 and pole contacts 1 and 2. FIG. 5 is a side cross-sectional view of the actual device including the portion of FIG. 6 taken along section lines 5—5. It can be seen that pole contact 1 has fingers 31 and 32 which are interdigitated with corresponding fingers 33 and 34 from pole contact 2. It can be seen that the non-planar ridge 36 overlies at least a portion of all of the fingers of both pole contacts 1 and 2.

Thus, in addition to providing a local stiffening of the membrane layer 22, the ridge will provide the structural support for the common contact area 26 when it comes into electrical contact with the interdigitated fingers 31 through 34. FIG. 5 also shows a tactile dome 3B which is used in a preferred embodiment to deflect the flexible membrane layer 22 in response to external actuation. The use of tactile domes is well known in membrane switches.

FIGS. *7a* through *7c* illustrate different arrangements of pole contacts which could be used in various embodiments of the present invention. FIG. *7a* illustrates the use of interdigitated fingers similar to that of FIGS. 5 and 6. FIG. *7b* illustrates the three pie shaped pole contacts, 40, 41 and 42 of a three pole momentary membrane switch in accordance with the present invention. The pole contact configuration of FIG. *7b* would merely be substituted for the pole contacts 1 and 2 in FIG. 5 and comprises a further embodiment which would provide simultaneous contact with three-pole contacts instead of the two previously discussed. A further embodiment of a three-pole momentary membrane switch is shown in FIG. *7c* in which pole contacts 44, 45 and 46 are illustrated as radially outwardly extending conductive line shaped poles rather than the pie-shaped poles of FIG. *7b*.

In view of the above disclosure, many different configurations of pole contacts will be readily apparent to those of ordinary skill in the art. Any number of pole contacts could be used with interdigitated fingers, pie-shaped sections or lines as long as they are capable of being contacted by the non-planar ridge formed by the common contact area on the underside of the membrane layer.

Similarly, although a preferred embodiment illustrates a circular non-planar ridge 36 different geometrical shapes could be utilized in order to assure maximum contact of the ridge with the underlying pole contacts. For example, squares, triangles and other geometric shapes as well as x's, y's or other line patterns could be utilized to provide a local stiffening in the area immediately above the pole contacts and to also provide the non-planar ridge for physically contacting the underlying pole contacts.

In view of the above disclosure and discussion, many variations and modifications of applicants' invention will be apparent to those to ordinary skill in the art. Although, the drawings and specification set forth preferred embodiments of the invention, and although specific terms are employed, they are used in a generic and descriptive sense only and are not for purposes of limitation. Therefore, applicants' invention is limited only by the claims appended hereto.

What is claimed is:

1. A multi-pole momentary contact membrane switch, said switch comprising:

substrate means for defining a dielectric substrate;

membrane means for defining a deflectable membrane overlying at least a portion of said substrate means;

spacer means for spacing said substrate means apart from said membrane means;

a plurality of conductive contact poles on said substrate means, said substrate means including means for insulating said plurality of conductive contact poles from one another;

conductive means for providing a common contact area on at least a portion of said membrane means, said membrane means including stiffening means for locally stiffening a limited portion of said deflectable membrane wherein said stiffening means includes at least one ridge extending from a portion of said deflectable membrane towards said contact poles, said at least one ridge including at least a portion of said conductive means; and tactile dome means for deflecting said flexible membrane in response to external actuation.

2. A multi-pole momentary contact membrane switch according to claim 1, wherein at least a portion of said at least one ridge overlies at least a portion of each of said plurality of contact poles.

3. A multi-pole momentary contact membrane switch according to claim 2, wherein said plurality of contact poles is comprised of two poles.

4. A multi-pole momentary contact membrane switch, said switch comprising:

substrate means for defining a dielectric substrate;

membrane means for defining a deflectable membrane overlying at least a portion of said substrate means;

spacer means for spacing said substrate means apart from said membrane means;

a plurality of conductive contact poles on said substrate means, said substrate means including means for insulating said plurality of conductive contact poles from one another;

conductive means for providing a common contact area on at least a portion of said membrane means, said membrane means including stiffening means for locally stiffening a limited portion of said deflectable membrane wherein said stiffening means comprises a depression extending away from said contact poles, said depression having edges, said edges of said depression comprising at least one ridge extending from the remainder of the depression towards said contact pole; and tactile dome means for deflecting said flexible membrane in response to external actuation.

5. A multi-pole momentary contact membrane switch according to claim 4, wherein said plurality of contact poles is comprised of two poles.

6. A multi-pole momentary contact membrane switch according to claim 5, wherein said depression and said at least one ridge have a generally circular shape.

7. A multi-pole momentary contact membrane switch according to claim 6, wherein said two poles comprise interdigitated fingers, and said generally circular at least one ridge overlies at least a portion of said interdigitated fingers.

8. A multi-pole momentary contact membrane switch according to claim 4, wherein said plurality of contact poles is comprised of three poles.

9. A multi-pole momentary contact membrane switch according to claim 8, wherein said three poles comprise generally pie shaped poles, wherein said depression and said at least one ridge have a generally circular shape overlying said pie shaped poles.

10. A multi-pole momentary contact membrane switch according to claim 8, wherein said three poles comprise generally radially outwardly extending line shaped poles, wherein said depression and said at least one ridge have a generally circular shape overlying said line shaped poles.

11. A multi-pole momentary contact membrane switch according to claim 4, wherein said depression and said at least one ridge has a generally circular shape.

12. A multi-pole momentary contact membrane switch, said switch comprising:

substrate means for defining a dielectric substrate;

membrane means for defining a deflectable membrane overlying at least a portion of said substrate means;

spacer means for spacing said substrate means apart from said membrane means;

a plurality of conductive contact poles on said substrate means, said substrate means including means for insulating said plurality of conductive contact poles from one another;

conductive means for providing a common contact area on at least a potion of said membrane means, said membrane means including stiffening means for locally stiffening a limited portion of said deflectable membrane, said stiffening means includes at least one ridge extending from a portion of said deflectable membrane towards said contact poles wherein at least a portion of said at least one ridge overlies at least a portion of each of said plurality of contact poles, said ridge including at least a portion of said conductive means; and tactile means for deflecting said flexible membrane in response to external actuation.

13. A multi-pole momentary contact membrane switch according to claim 12, wherein said plurality of contact poles is comprised of two poles and said stiffening means comprises a generally circular depression extending away from said contact poles, said depression having edges, said edges of said depression comprising at least one ridge extending from the remainder of the depression towards said two poles, said ridge overlying at least a portion of said two poles.

* * * * *